US010767374B1

(12) United States Patent
Minerd

(10) Patent No.: US 10,767,374 B1
(45) Date of Patent: Sep. 8, 2020

(54) FLOORBOARD GAP FIXING TOOL

(71) Applicant: Michael G. Minerd, Pittsburgh, PA (US)

(72) Inventor: Michael G. Minerd, Pittsburgh, PA (US)

( * ) Notice: Subject to any disclaimer, the term of this patent is extended or adjusted under 35 U.S.C. 154(b) by 339 days.

(21) Appl. No.: 15/718,923

(22) Filed: Sep. 28, 2017

Related U.S. Application Data

(60) Provisional application No. 62/400,719, filed on Sep. 28, 2016.

(51) Int. Cl.
*E04F 21/22* (2006.01)
*B25D 1/00* (2006.01)

(52) U.S. Cl.
CPC ..... *E04F 21/22* (2013.01); *B25D 1/00* (2013.01)

(58) Field of Classification Search
CPC ..... E04F 21/22; E04F 15/04; E04F 15/02; B25D 1/00; B25B 1/205; B25B 27/02; B25B 33/00; B25B 27/0035; B25B 9/00; B25B 13/48; B25B 27/00; B66F 3/00; B66F 3/02; B66F 19/00; E04G 21/00
See application file for complete search history.

(56) References Cited

U.S. PATENT DOCUMENTS 286,981 A * 10/1883 Williams ..... E04F 21/22 254/13
3,616,029 A * 10/1971 Lerman ..... B29C 67/20 156/276
3,899,117 A * 8/1975 Peyser ..... B65D 15/08 229/5.5
4,266,586 A * 5/1981 Brown ..... B25B 27/02 254/11
5,894,705 A * 4/1999 Sutton ..... E04F 21/22 248/362
6,701,596 B2 * 3/2004 Kloepfer ..... B25B 1/103 254/13
7,900,420 B2 * 3/2011 Pope ..... E04F 21/20 173/13

* cited by examiner

*Primary Examiner* — Robert J Scruggs
(74) *Attorney, Agent, or Firm* — Cramer Patent & Design, PLLC; Aaron R. Cramer

(57) ABSTRACT

A tool that lessens or eliminated gaps between adjacent floorboards of a floating floor includes a tubular base member, a pair of end caps attached at distal ends of the base member, and an adhesive pad affixed to a bottom surface of the base member. The adhesive pad removably adheres to one (1) of the floorboards adjacent a gap and the end caps are configured to receive a striking force that transfers the force to the base member and subsequently the floorboard in the direction of the gap.

14 Claims, 4 Drawing Sheets

FLOORBOARD GAP FIXING TOOL

RELATED APPLICATIONS

The present invention was first described in and claims the benefit of U.S. Provisional Application No. 62/400,719, filed Sep. 28, 2016, the entire disclosures of which are incorporated herein by reference.

FIELD OF THE INVENTION

The present invention relates generally to a tool used to fix and close gaps between adjacent planks of floating laminate or floating plank floor systems.

BACKGROUND OF THE INVENTION

Gaps are created between adjacent floor planks on floating floor systems between the short ends of adjacent planks within a row either due to poor installation, a change in humidity, an un-level subfloor and or high traffic, and other causes. There are a few currently available methods for fixing this common occurrence. Such methods are time consuming and potentially damaging to the floor planks and or wall base board molding.

The current tools used to fix this common problem require the removal of the wall base board molding and quarter round commonly known as kick molding or shoe molding. The removal of the molding allows for a tool with a flange to be inserted at the beginning or the end of the row of planks where the gap between adjacent floorboards has occurred. The user inserts the tool such that the flange of the tool makes contact with the side of the floorboard that is exposed only after the removal of the wall board base molding. Force is then applied to the device by hitting with a hammer or prying with a pulling iron. The entire row of planks must be moved at one (1) time in order to close the gap.

There are numerous disadvantages to using the currently available devices to close the aforementioned gaps. First, wall base board molding needs to be removed in order to gain access to the end or beginning of the row in which the gap has occurred. Under most circumstances, this is not feasible because furniture or appliances are blocking access to all or a portion of the wall base board molding. Second, removal of the wall base board molding is difficult, requires special tools and skills, and it is not uncommon during the removal process for damage to occur to the molding, the wall, or the flooring planks. Third, a large amount of force must be generated in a horizontal direction in order to move the entire row of planks. The force applied can cause chipping or damage to the floor plank in which the force is initially exerted. Fourth, in order to use the currently available devices, there is a lot of setup which includes moving furniture, gather various tools to remove wall base board molding and careful removal of the wall base board molding. After the gap is closed, wall base board molding will need to be reattached to the wall and furniture will need to be move back to its previous location. The entire process will need to be repeated when another gap between adjacent flooring planks occurs. Often times the hassle of closing frequently occurring gaps using the currently available methods and tools is too great and a homeowner will not fix the gaps.

Another currently available method for closing gaps between floor planks is to fill in the gaps with wood filler or another filler compound. The compound is then allowed to dry. After drying the compound is then sanded and stained.

There are numerous disadvantages to using compound to fill in gaps that occur between adjacent floor planks. First, the process does not allow the planks to expand and contract with changes in humidity which can lead to floor planks buckling. Second, it is difficult to match the texture and the color of the filler compound to that of the surrounding floor planks. This leaves the gap filler compound noticeably different than the surrounding floor planks.

There are numerous advantages that a tool can employ that lessens or eliminates the problems identified above. A first benefit that such an invention can eliminate the need to remove any wall base board molding. Such an invention attaches to the top face of the floating floor planks. No special tools, skill or care is needed to remove wall base board molding because there is no need to gain access to the side of the floating floor plank. No wall base board molding need be removed to use the invention. The amount of time needed to close gaps that occur between adjacent floor planks is minimal compared to using currently available methods and devices. A second benefit of such a tool would substantially lessen the amount of force needed to generate horizontal movement of the floor planks. Floor planks are moved one (1) at a time rather than having to move multiple floor planks at one (1) time with a force generated at the beginning or end of each row. Each floor plank is moved individually and force is exerted only on the floor plank the invention is temporarily attached. A third benefit of such a device would eliminate the need to use messy compounds, fillers or stains to close gaps. There are numerous other advantages not listed that this invention has over currently available devices.

Some efforts to address this issue have been made. DE 202011104029 in the name of Flimm, U.S. Pat. App. Pub. No. 2006/278046 in the name of Gargano, U.S. Pat. No. 1,161,207 in the name of Hagel, and the Pacesetter® Combination Tapping Block. However, these solutions are not satisfactory. Therefore, there is a need for such a floating floorboard gap fixing tool that is easy to manipulate, does not damage the floorboards, and is lightweight, resilient, and durable. The present invention fulfills this need.

SUMMARY OF THE INVENTION

In view of the foregoing references, the inventor recognized the aforementioned inherent problems and observed that there is a need for a way to fix gaps that are inevitably formed between individual planks of floating floorboards.

To achieve the above objectives, it is an object of the present invention to provide a gap fixing tool that is heavy duty, lightweight, resilient enough to resist damage due to repeated striking, and capable of transferring a strike force to a subjacently attached floorboard plank to close the gap between it and an adjacent floorboard plank. Such a tool includes a base member, having a pair of distal ends, and a bottom surface. An adhesive pad is affixed to the bottom surface and is capable of removably adhering to a floorboard plank. A pair of end caps are affixed to the distal ends of the base member is some embodiments, and removably attached in other embodiment. The end caps provide a striking target for a mallet or other similar striking tool.

In certain embodiments, the base member is tubular with a square cross-section. Preferably, the material is made out of aluminum. However, other embodiments allow for the base member to be a solid material and also encompass any one (1) of different cross sections, such as circular, rectangular, oval, triangular, etc., and different sizes and materials, such as wood, plastic, steel, or other metal.

In certain other embodiments, the end caps are preferably made of heavy wall polyethylene square tubing plugs. Preferably, the end caps are permanently force fit inside the distal ends base member and do not extend beyond the top, bottom or side faces thereof. However, the end caps can be made from plastic, metal, rubber, other material and can be attached inside, outside, around the base member or not at all.

In certain other embodiments, the adhesive pad is made from an acrylic foam sheet that covers substantially the entire bottom face of the base member. However the micro suction pad can be made from different materials such as adhesives, dry adhesives, or suction cups. Furthermore, the adhesive pad can have different cross-sections, such as circular, square, triangular, oval etc., and it can cover varying amounts of surface area on the bottom face of the base member. Other means of bonding to the base member can occur, such as, glue, weldments, adhesive tape, or other fastening means.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
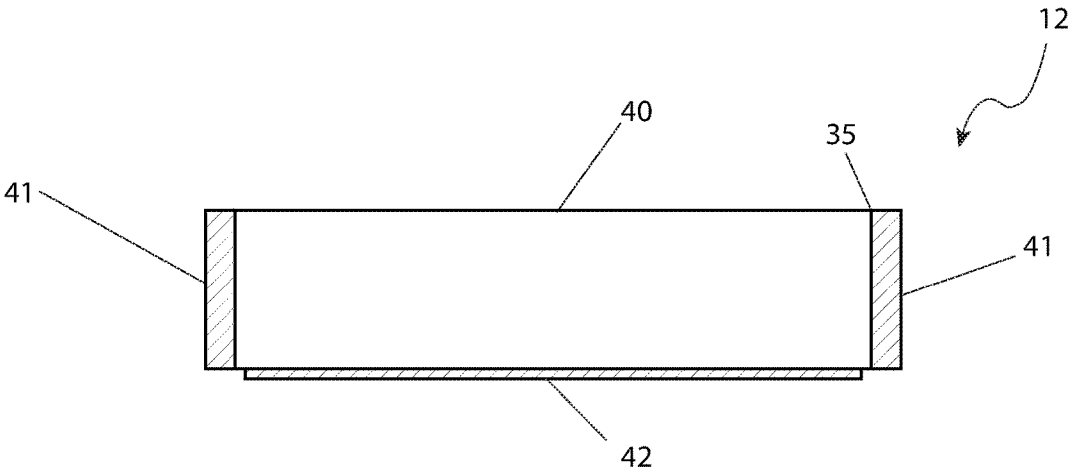
FIG. 1 is a first side view of a preferred embodiment of a gap fixing tool 12.

9 first quarter round molding
9A second quarter round molding
10 first wall base board molding
10A second wall base board molding
11 first wall
11A second wall
12 gap fixing tool
13 gap
14 first subsequent gap
16 second subsequent gap
17 first wall-adjacent floorboard
17A second wall-adjacent floorboard
18 floating floor floorboard
19 first gap-adjacent floorboard
19A second gap-adjacent floorboard
19B third gap-adjacent floorboard
19C fourth gap-adjacent floorboard
30 interior
35 distal end
40 base
41 end cap
42 suction pad
43 end cap insert member

DETAILED DESCRIPTION OF THE PREFERRED EMBODIMENT

The best mode for carrying out the invention is presented in terms of its preferred embodiment, herein depicted within FIGS. 1-3, 10, and 11 and an intended method of use depicted in FIGS. 4-9. However, the invention is not limited to the described embodiment, and a person skilled in the art will appreciate that many other embodiments of the invention are possible without deviating from the basic concept of the invention and that any such work around will also fall under the scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The gap fixing tool (herein described as the "tool") 12, is particularly suited for reducing or eliminating gaps that occur between adjacent floorboards 19, 20 of a floating flooring installation. Referring to FIG. 1, a view from a first side of the tool 12, illustrates the base 40, a pair of end caps 41 each removably attached to distal ends 35 of the base 40, and a suction pad 42 bonded to a bottom surface of the base 40 in this preferred embodiment. Other materials, such as metallic, plastic, or wood may also be used as well. Also, it is appreciated that the base 40 can be a solid structure in some embodiments. Preferably the base 40 can be made from an aluminum square tube with a cross section of two inches by two inches (2×2 in.) with one-eighth inch (⅛ in.) wall and is ten inches (10 in.) long. Such a shape is beneficial in that it is able to fully fit onto most conventional sized floating floorboards on the market.

The base 40, in a preferred embodiment, is hollow which defines an interior 30. This enables for the friction fitting of the insert portion 43 of the end caps 41 on each distal end 35 of the base 40. Preferably, the end caps 41 are made of a heavy wall polyethylene square tubing plugs specifically made for two inch square (2 in.$^2$) tubing with a one-eight inch (1/8 in.) wall. The end caps 41 are preferably permanently force fit inside the openings on each distal end 35 of the base 40, although other embodiments may provide end caps 41 that are removably attached to the distal ends 35 of the base 40. In the preferred embodiment, the end caps 41 each have an insert portion 43 having an area enabling minimal or no clearance with the inner wall of the interior 30 of the distal ends 35 of the base 40. It is preferred that the perimeter edges of the end caps 41 is coextensive with the perimeter edges of the distal ends 35 of the base 40, such that the tool 12 has a continuous width when either or both end caps 41 are affixed or attached to the base 40.

The suction pad 42 is preferably made from acrylic foam sheet measuring one-point-nine hundred seventy-five inches (1.975 in.) wide by nine-point-ninety-five inches (9.95 in.)

long by eight-tenths of a millimeter (0.8 mm) thick. The suction pad 42 has a first side which is bonded to the bottom of the base 40 with an adhesive. The adhesive may be permanent or non-permanent. The preferred acrylic foam sheet material is suitable for removable adherence to materials typically associated with conventional floating floorboards, such as wood or laminate. The second side opposite the first side of the suction pad 42 is preferably backed with a releasable backing, intended to be removed prior to use.

Figure 2:
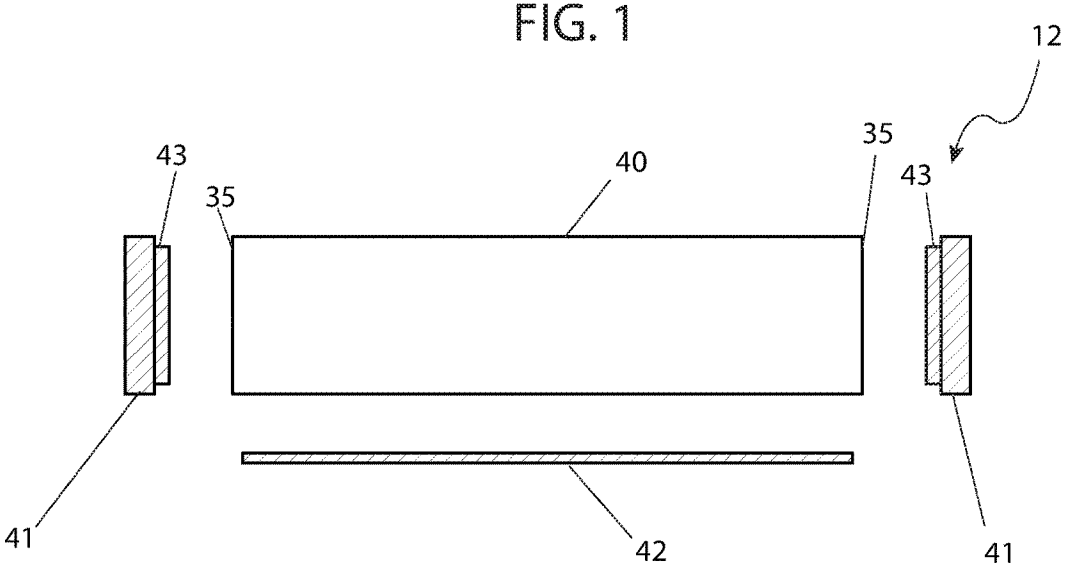
FIG. 2 is an exploded first side elevation view of the tool 12.
Figure 10:
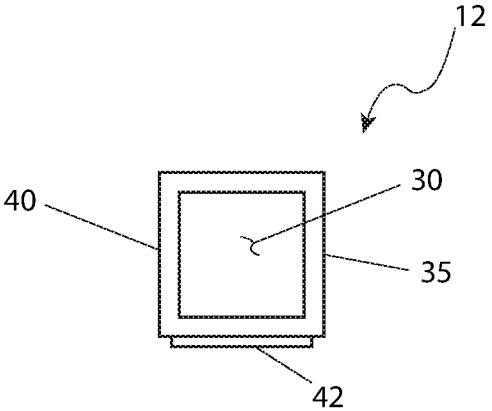
FIG. 10 is a side elevation view of the distal end 35 of the base 40 of the tool 12; and, FIG. 11 is a side elevation view of an individual end cap 41 of the tool 12.

FIG. 2 depicts an exploded first side view of the tool 12 showing the base 40, the end caps 41 and the suction pad 42 in this preferred embodiment. In some embodiments, the base 40 is a square tube with a cross-section of two by two inches (2×2 in.) with one-eighth inch (⅛ in.) wall and is ten inches (10 in.) long and made of aluminum. However, the base 40 can have different cross-sections, such as circular, rectangular, oval, triangular, etc., and different sizes and materials, such as wood, plastic, steel or other metal. FIG. 10 depicts one (1) of the distal ends 35 with the respective end cap 41 not present, so the interior 30 can be seen.

Figure 3:
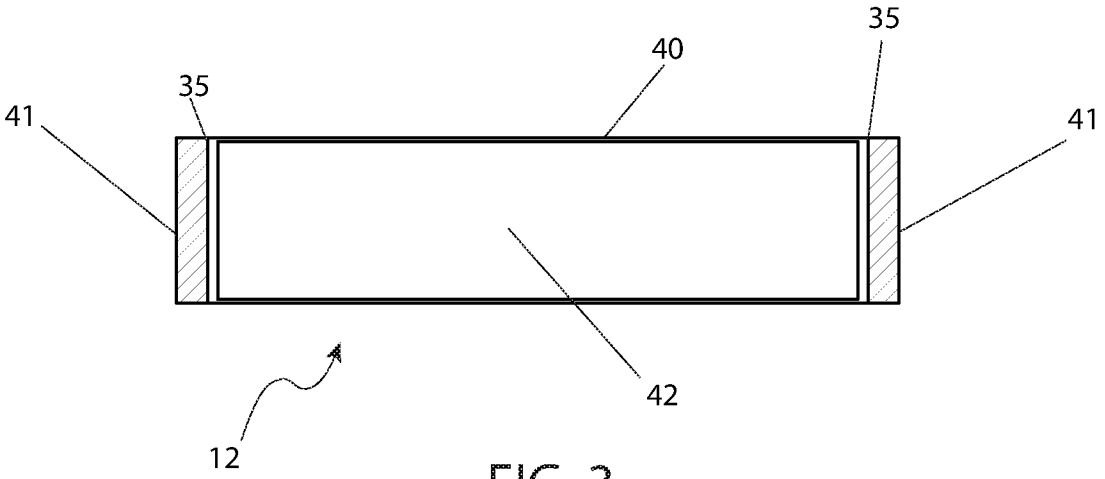
FIG. 3 is a bottom plan view of the tool 12.

FIG. 3 is a perspective bottom-side view of the invention showing the end caps 41 and the suction pad 42. The suction pad 42 is preferably attached to and extends the substantially the entire width and length of the base 40 in this preferred embodiment.

Figure 11:
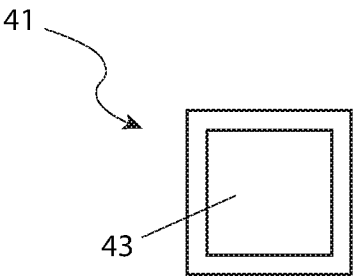

In some embodiments, the end caps 41 are made of heavy wall polyethylene square tubing plugs two by two inches (2×2 in.) and are friction fit into the hollow longitudinal distal ends 35 of the base 40. FIG. 11 illustrates the insert portion 43 of an individual end cap 41 in a preferred embodiment such that it can be inserted into the distal ends 35 of the base 40 when the base 40 embodiment is tubular. However other embodiments of the device do not require end caps 41 or have end caps 41 made from plastic, metal, rubber, other material and can be attached inside, outside, or around the base 40 such that the end caps 41 and base 40 do not have a continuous outer perimeter edge.

In some embodiments, the suction pad 42 is a rectangle with a cross-section of one-point-nine hundred seventy-five inches (1.975 in.) wide by nine-point-ninety-five inches (9.95 in.) long by eight-tenths of a millimeter (0.8 mm) thick and covers substantially the entire bottom face of the base 40 and is bonded thereto with an adhesive. However, the suction pad 42 can have different cross-sections, such as circular, square, triangular, oval etc., and can cover varying amounts of surface area on the bottom face of the base 40. The suction pad 42 can be bonded thereto by adhesive, glue, heat welded, taped, or another similar bonding means.

Figure 4:
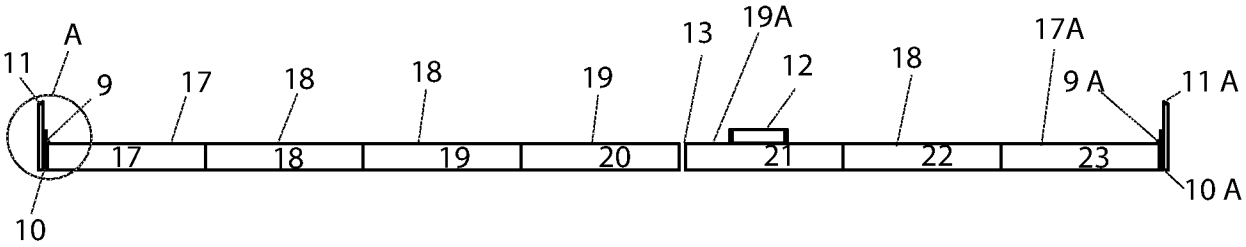
FIG. 4 is a side view showing a gap 13 between adjacent floorboards 17, 17A, depicting a first step in a preferred operation of the tool 12.
Figure 5:
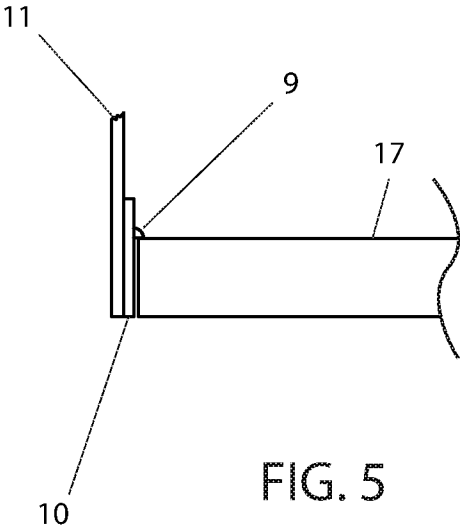
FIG. 5 is a close-up view of detail A (see FIG. 4)

FIG. 4 illustrates a first step of a preferred method of use for the tool 12, wherein a gap 13 exists between two (2) adjacent floorboards 19, 20. In this illustration, there are seven (7) floorboard planks 17, 17A, 18, 19, 19A that form a single row extending from first wall 11 to second wall 11A. A first wall base board molding 10 and a first quarter round molding 9 are attached to the first wall 11 at the beginning of the row and cover the end of the first wall-adjacent floorboard 17 in the row (as depicted in FIG. 5). A second wall base molding 10A and a second quarter round molding 9A are attached to the second wall 11A at the end of the row and cover the end of the second wall-adjacent floorboard 17A in the row. A gap 13 exists between the first gap-adjacent floorboard 19 (the fourth plank in the row) and the second gap-adjacent floorboard 19A (the fifth plank in the row). To close the gap 13 that exists between the floorboards 19, 19A in the row, the gap 13 is first cleaned of all debris using a vacuum or other means. The tool 12 is preferably placed onto and adhered to the gap-adjacent floorboard closest to either wall (in the illustrated example, this would be the second gap-adjacent floorboard 19A which is closest to the second wall 11A). This is achieved by offering the suction pad 42 bonded to the bottom face of the tool 12 to the top face of the second gap-adjacent floorboard 19A. The tool 12 is firmly attached to the second gap-adjacent floorboard 19A approximately one inch (1 in.) from the edge of the second gap-adjacent floorboard 19A nearest to the gap 13 by imparting a firm force on the tool 12. This can be accomplished by hand.

Figure 6:
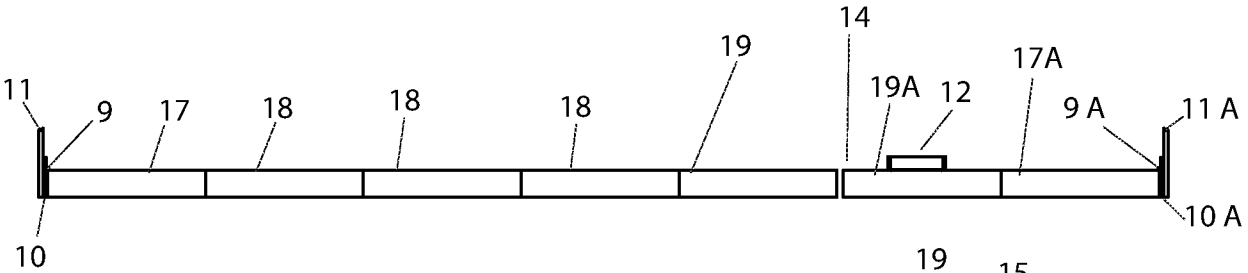
FIG. 6 is a side view showing a gap 13 between adjacent floorboards 17, 17A, depicting a subsequent step in a preferred operation of the tool 12.

The end cap 41 of the tool 12 furthest from the gap 13 is then struck with a striking tool such as a mallet or hammer. The striking force delivered to the tool 12 is then transferred to the second gap-adjacent floorboard 19A in a horizontal direction such that the second gap-adjacent floorboard 19A travels relative to the base floor. Each impact of the striking tool on the tool 12 will result in horizontal movement of the second gap-adjacent floorboard 19A in the direction of the first gap-adjacent floorboard 19. Continued striking of the tool 12 in the above manner results in closing the gap 13 that existed between the first gap-adjacent floorboard 19 and second gap-adjacent floorboard 19A in the row. The complementary facing ends of the first gap-adjacent floorboard 19 and second gap-adjacent floorboard 19A are now snuggly fit together. When the operation is complete, a new gap 13 will have formed between the fifth plank of the row (now described as the first gap-adjacent floorboard 19) and the sixth plank of the row (now described as the second gap-adjacent floorboard 19A) as shown in FIG. 6. The tool 12 is removed from the fifth plank of the row by prying up on the tool 12 by hand.

FIG. 6 illustrates a subsequent step from that illustrated in FIG. 4 except that FIG. 6 shows the gap 13 that did exist between the fourth plank and fifth plank in FIG. 4 is now closed and a new subsequent gap 14 has formed between the fifth plank (now described as the first gap-adjacent floorboard 19) and the sixth plank (now described as the second gap-adjacent floorboard 19) due to the operation of the tool 12. To close the subsequent gap 14 that exists between the fifth plank (now described as the first gap-adjacent floorboard 19) and the sixth plank (now described as the second gap-adjacent floorboard 19) in the row, the tool 12 is adhered to the sixth plank (now described as the second gap-adjacent floorboard 19) by offering the suction pad 42 bonded to the bottom face of the tool 12 to the top face of the sixth plank (now described as the second gap-adjacent floorboard 19). The tool 12 is firmly attached to the sixth plank (now described as the second gap-adjacent floorboard 19) approximately one inch (1 in.) from the edge of the sixth plank (now described as the second gap-adjacent floorboard 19) nearest to the gap 13 by imparting a firm force (preferably by hand).

Figure 7:
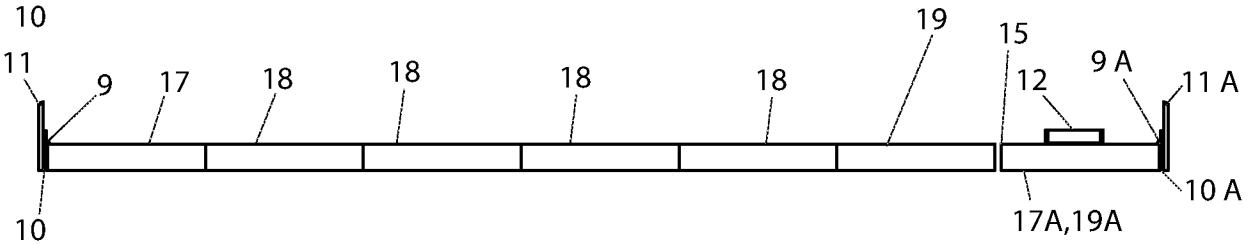
FIG. 7 is a side view showing a gap 13 between adjacent floorboards 17, 17A, depicting a second subsequent step in a preferred operation of the tool 12.

The end cap 41 of the tool 12 furthest from the subsequent gap 14 is then struck, which then transfers the striking to the sixth plank (now described as the second gap-adjacent floorboard 19) in a horizontal direction such that the sixth plank (now described as the second gap-adjacent floorboard 19) travels relative to the base floor. Each impact of the striking tool will result in horizontal movement of the sixth plank (now described as the second gap-adjacent floorboard 19) in the direction of the fifth plank (now described as the first gap-adjacent floorboard 19). Continued striking of the tool 12 in the above manner results in closing the subsequent gap 14 that exists between the fifth plank (now described as the first gap-adjacent floorboard 19) and the sixth plank 22 in the row. The complementary facing ends of the fifth plank (now described as the first gap-adjacent floorboard 19) and the sixth plank (now described as the second gap-adjacent floorboard 19) are now snuggly fit together. When the operation is complete, a new second subsequent gap 16 will have formed between the sixth plank (now described as the first gap-adjacent floorboard 19) and the seventh plank (now described as the second gap-adjacent floorboard 19) as shown in FIG. 7. The tool 12 is then preferably removed by hand from the sixth plank (now described as the first gap-adjacent floorboard 19) by prying up.

FIG. 7 illustrates a second subsequent step from that illustrated in FIG. 6 except that FIG. 7 shows the subsequent gap 14 that did exist between the fifth plank and sixth plank in FIG. 6 is now closed and a second subsequent gap 16 has formed between the sixth plank (now described as the first gap-adjacent floorboard 19) and the seventh plank (now described as the second gap-adjacent floorboard 19) due to the operation of the tool 12. To close the second subsequent gap 16 that exists between the sixth plank (now described as the first gap-adjacent floorboard 19) and the seventh plank (now described as the second gap-adjacent floorboard 19) in the row, the tool 12 is adhered to the seventh plank (now described as the second gap-adjacent floorboard 19) by offering the suction pad 42 bonded to the bottom face of the tool 12 to the top face of the seventh plank (now described as the second gap-adjacent floorboard 19). The tool 12 is firmly attached to the seventh plank (now described as the second gap-adjacent floorboard 19) approximately one inch (1 in.) from the edge of the seventh plank (now described as the second gap-adjacent floorboard 19) nearest to the gap 13 by imparting a firm force (preferably by hand).

The end cap 41 of the tool 12 furthest from the second subsequent gap 16 is then struck, which then transfers the striking to the seventh plank (now described as the second gap-adjacent floorboard 19) in a horizontal direction such that the seventh plank (now described as the second gap-adjacent floorboard 19) travels relative to the base floor. Each impact of the striking tool will result in horizontal movement of the seventh plank (now described as the second gap-adjacent floorboard 19) in the direction of the sixth plank (now described as the first gap-adjacent floorboard 19). Continued striking of the tool 12 in the above manner results in closing the second subsequent gap 16 that exists between the sixth plank (now described as the first gap-adjacent floorboard 19) and the seventh plank 22 in the row. The complementary facing ends of the sixth plank (now described as the first gap-adjacent floorboard 19) and the seventh plank (now described as the second gap-adjacent floorboard 19) are now snuggly fit together. When the operation is complete, the gap has traversed underneath the second quarter round molding 9A and second wall base board molding 10A at the second wall 9A. The tool 12 is then preferably removed by hand from the seventh plank (now described as the first gap-adjacent floorboard 19) by prying up.

Figure 8:
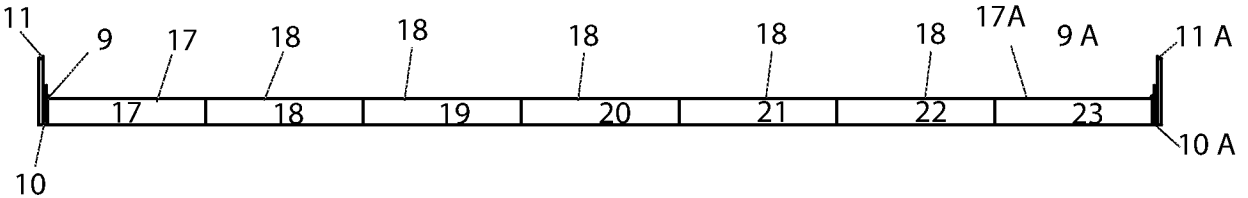
FIG. 8 is a side view showing a final disposition of a preferred operation of the tool 12.

FIG. 8 illustrates the second subsequent gap 16 that did exist between the sixth plank and seventh plank in FIG. 7 is now closed. No gaps exist between the flooring planks in the row. Also, the quarter round molding 9 at the beginning of the row covers the end of the first wall-adjacent floorboard 17 in the row and the second quarter round molding 9A at the end of the row covers the end of the second wall-adjacent floorboard 17A in the row.

Figure 9:
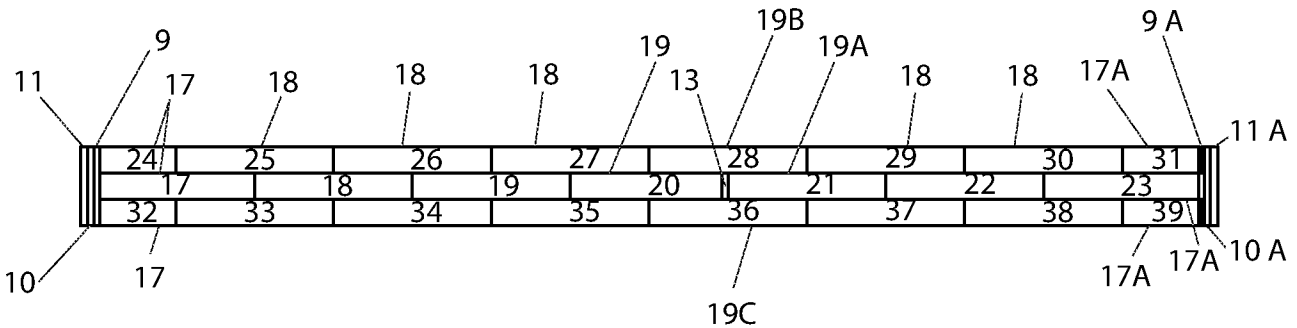
FIG. 9 is a top view showing a gap between four (4) adjacent floorboards 19, 19A, 19B, 19C.

FIG. 9 is a top view showing additional rows of flooring planks. There are three (3) rows of flooring planks shown. The first row is made up of seven (7) floor planks, the second row is made up of seven (7) floor planks, and the third row is also made up of seven (7) floor planks. The first wall-adjacent floorboards 17 of each row is covered by wall base molding 10 and quarter round molding 9, both of which are attached to the first wall 11. The second wall-adjacent floorboards 17A of each row is covered by the second wall base molding 10A and second quarter round molding 9A, both of which are attached to the second wall 11A. A gap 13 exists between the first gap-adjacent floorboard 19, second gap-adjacent floorboard 19A, third gap-adjacent floorboard 19B, and fourth gap-adjacent floorboard 19C. Closure of this gap 13 is accomplished using the method described above.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A floorboard gap fixing tool comprising:

a flat horizontal base member having a first end, a second end, and a bottom side;

a first end cap affixed to said base member first end;

a second end cap affixed to said base member second end; and an adhesive pad affixed to said bottom side;

wherein said adhesive pad is removably adhered to a substrate;

wherein a striking force delivered to one of said end caps imparts a horizontal movement to said base member and subsequently said substrate when said tool is adhered thereto;

wherein a width of each end cap and said base member is coextensive;

wherein each said end cap and said base member comprises a square cross-section;

wherein each said end cap comprises an insert portion that extends into said base member at a respective end; and wherein said adhesive pad covers substantially a majority portion of said bottom side.

2. The floorboard gap fixing tool of claim 1, wherein each said end cap is made of a heavy wall polyethylene material.

3. The floorboard gap fixing tool of claim 1, wherein said base member is tubular.

4. The floorboard gap fixing tool of claim 1, wherein each said end cap is made of a heavy wall polyethylene material.

5. The floorboard gap fixing tool of claim 1, wherein said tubular base member is aluminum.

6. The floorboard gap fixing tool of claim 1, wherein said adhesive pad is an acrylic foam sheet.

7. A floorboard gap fixing tool, comprising:

a flat horizontal tubular base member having a first end, a second end, and a bottom side;

a first end cap removably attached to said base member first end;

a second end cap removably attached to said base member second end; and an adhesive pad affixed to said bottom side;

wherein said adhesive pad is removably adhered to a substrate;

wherein a striking force delivered to either end cap imparts a horizontal movement to said base member and subsequently said substrate when said tool is adhered thereto;

wherein a width of each said end cap and said base member is coextensive;

wherein each said end cap and said base member comprises a square cross-section;

wherein said adhesive pad covers substantially a majority portion of said bottom side.

8. The floorboard gap fixing tool of claim 7, wherein each said end cap is a heavy wall polyethylene material.

9. The floorboard gap fixing tool of claim 7, wherein said base member is tubular.

10. The floorboard gap fixing tool of claim 9, wherein each said end cap comprises an insert portion that extends into said base member at a respective end.

11. The floorboard gap fixing tool of claim 10, wherein each said end cap and said base member comprises a square cross-section.

12. The floorboard gap fixing tool of claim 10, wherein each said end cap is a heavy wall polyethylene material.

13. The floorboard gap fixing tool of claim 7, wherein said tubular base member is aluminum.

14. The floorboard gap fixing tool of claim 7, wherein said adhesive pad is an acrylic foam sheet.

* * * * *